United States Patent [19]

Drogo

[11] Patent Number: 5,035,640

[45] Date of Patent: Jul. 30, 1991

[54] ELECTRIC CONNECTOR

[76] Inventor: Pierre L. M. Drogo, Le Verdier, 45570 Ouzouer sur Loire, France

[21] Appl. No.: 473,726

[22] Filed: Feb. 2, 1990

[30] Foreign Application Priority Data

Feb. 3, 1989 [FR] France ..... 89 01420

[51] Int. Cl.[5] ..... H01R 4/38

[52] U.S. Cl. ..... 439/321; 439/320

[58] Field of Search ..... 439/306–321

[56] References Cited

U.S. PATENT DOCUMENTS 3,351,886 11/1967 Zimmerman ..... 439/319
3,917,373 11/1975 Peterson ..... 339/89
3,971,614 7/1976 Paoli et al. ..... 339/89
4,506,943 3/1985 Drogo ..... 439/314
4,900,260 2/1990 Drogo ..... 439/321

FOREIGN PATENT DOCUMENTS 0246934 11/1987 European Pat. Off. .
2002273 10/1969 France ..... 439/321
2109645 6/1983 United Kingdom .

*Primary Examiner*—David L. Pirlot
*Attorney, Agent, or Firm*—Kenyon & Kenyon

[57] ABSTRACT

An electric connector comprising connecting means between a connector plug body and lock which are adapted to brake the rotation of the lock in the unscrewing direction with a force greater than the force braking the lock in the direction of screwing of the latter.

10 Claims, 2 Drawing Sheets

1
2
3
4
5
6
7
8
9
11
12
13
14
15
16
17
18
20
21
22
23
24
25
26
26a
26a1
26a2
26b
27
28
28a
28a1
28a2
29
F
III

ELECTRIC CONNECTOR

FIELD OF THE INVENTION

The present invention relates essentially to an electric connector device usable for the connection of electric cables and like wire leads or conductors.

Such a connector is applicable in particular to the conveyance of quick information signals such as is the case for instance with operating and control appliances used in aircrafts.

BACKGROUND OF THE INVENTION

There is known an electric connector of the kind comprising a base flange, a plug and a bolt or lock mounted onto the plug body for making the plug fast with the base flange through screwing. Connecting means are provided between the plug body and the bolt or lock to brake the rotation of the lock in either direction with respect to the plug body. These connecting means are in particular adapted to prevent the lock from being loosened or unscrewed from the base flange body due to outer vibrations transmitted to the electric connector. The connecting means consist of splines arranged on the periphery of an annular portion of the plug body and extending in parallel relation to the longitudinal center line axis of this body and of a number of resilient metal strips or tongues secured in angularly equidistant relationship to an inner cylindrical wall of the lock and comprising each one a boss engaging the spaces between adjacent splines.

Such braking means however offer little resistance in particular to loosening or unscrewing of the lock from the base flange body and are therefore practically ineffective.

Moreover the fastening of the tongues or strips of the braking means to the lock body is not convenient and thus does not facilitate their replacement in case of defectiveness thereof.

SUMMARY OF THE INVENTION

A main object of the present invention is to remove the inconveniences referred to hereinabove by providing an electric connector of the kind comprising a base flange, a plug, a lock or bolt mounted on the plug body to make the plug fast with the base flange through screwing and connecting means between the plug body and the lock for braking the rotation of the lock in either direction in relation to the plug body and characterized in that the connecting means are arranged so as to brake the rotation of the lock in the unscrewing direction thereof with a force higher than the force for braking the lock in the screwing direction of the latter.

According to a characterizing feature of the invention the connecting means comprise first and second coaxial wheels the mutually confronting side faces of which comprise teeth having each one faces with gentle and steep slopes, respectively, and kept in meshing engagement with each other by the drawback force of a resilient biassing member, the second wheel being made fast with the lock body whereas the first wheel is held against rotation with respect to the plug body and is axially displacable in relation thereto against the drawback force of the resilient biassing member, so that the rotation of the lock in the screwing direction causes the faces with a gentle slope of the teeth of the second wheel to slip on the mating or corresponding faces with a gentle slope of the teeth of the first wheel and the rotation of the lock in the unscrewing direction brings the faces with a steep slope of the teeth of the second wheel in abutting engagement with the corresponding faces with a steep slope of the teeth of the first wheel.

According to another characterizing feature of the invention the plug body comprises at least one pins integral therewith and engaging an inner groove of complementary or mating shape of the first wheel.

According to still another characterizing feature of the invention two diametrally opposite snugs are secured to the plug body and engaging two complementary or mating inner grooves, respectively, of the first wheel.

Advantageously the second wheel is made fast with the lock body through screwing thereof into the lock body.

Preferably the resilient biassing or return member consists of a corrugated or ripple ring interposed between the side face of the first wheel opposite from its toothed or serrated face and an inner annular wall of the lock.

According to still a further characterizing feature of the invention the plug body comprises a collar bearing against the side face of the inner annular wall opposite to that against which is bearing the resilient biassing member.

For assembling the lock to the plug body the inner annular wall of the lock comprises two grooves for the passage of both snugs, respectively, between the first wheel and the annular wall, both snugs being then accommodated within two grooves, respectively, of the first wheel through rotation of the plug body with respect to the lock.

The lock comprises an inner screw-threading formed towards the side face of the inner annular wall of the lock onto which is bearing the collar and co-operating with an outer screw-threading of the base flange body.

Preferably both toothed or serrated wheels are made from hard steel.

BRIEF DESCRIPTION OF THE DRAWINGS

For a fuller understanding of the invention, reference is made to the following description in conjunction with the accompanying drawings, in which.

DETAILED DESCRIPTION OF THE PREFERRED EMBODIMENTS

Figures 1, 2A, 2B:
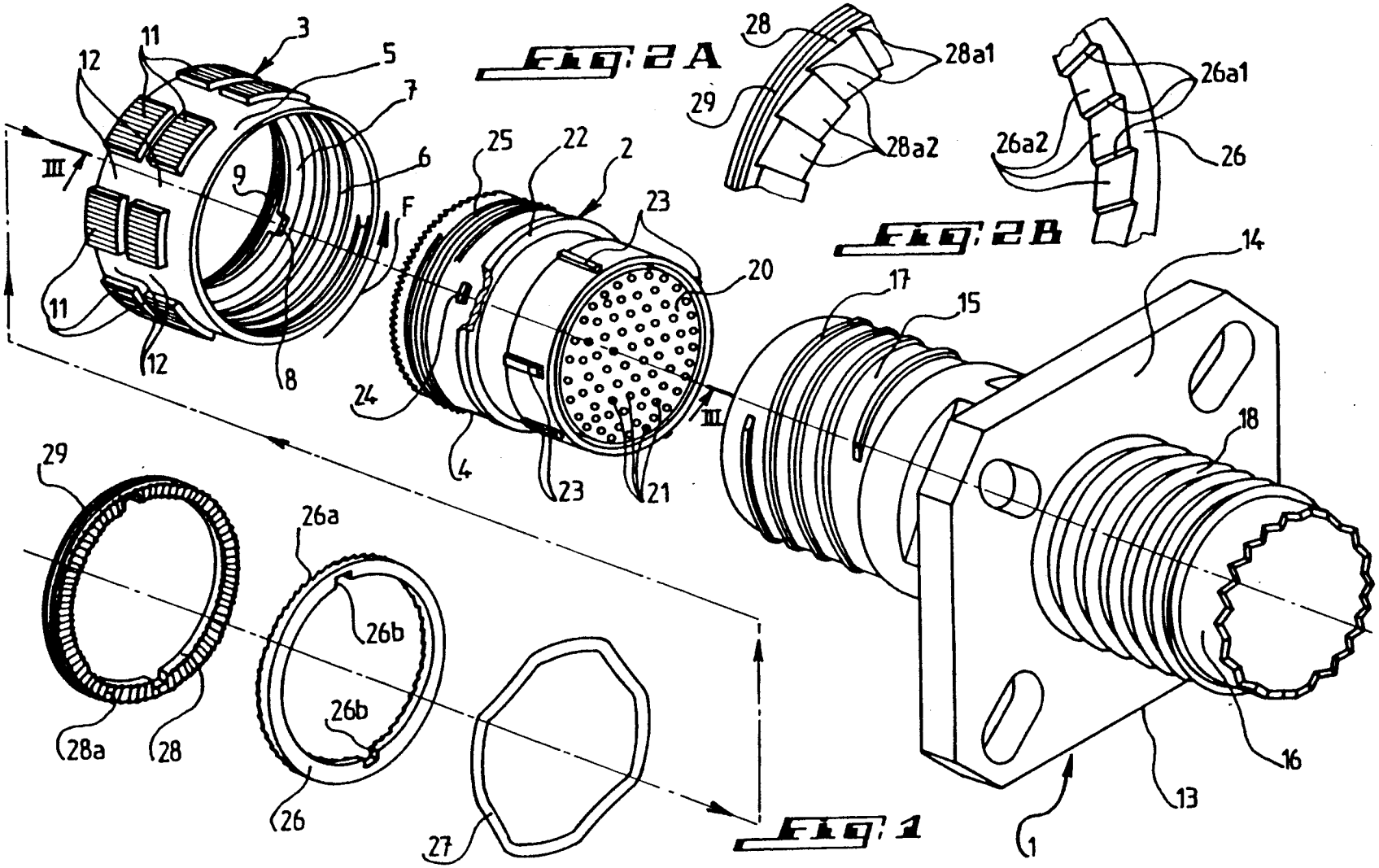
FIG. 1 is an exploded view of the electric connector according to the invention.
FIGS. 2A and 2B show two portions, respectively, of both toothed wheels used in the connector according to the invention.

Referring to the Figures the electric connector comprises a base flange adapted to be secured to a suitable stationary support, a plug 2 and a lock or bolt 3 mounted onto the body 4 of the plug 2 for making the latter fast with the base flange 1.

The body 5 of the lock 3 exhibits the shape of a sleeve comprising an inner threading 6 machined onto a determined inlet portion of the inner cylindrical wall of the sleeve. The sleeve 5 also comprises an inner annular wall 7 separated from the inner threading 6 and comprising two diametrally opposite grooves or slots 8 extending through the wall 7. An inner threading 9 is also machined onto an outlet portion of the inner cylindrical wall of the sleeve 5 and defines together with the annular wall 7 an annular accommodating cavity or recess 10. The sleeve 5 comprises on its outer periphery a number of raised fluted sectors 11 angularly and regularly spaced from each other and adapted to facilitate the manual handling of the lock 3 during the operating steps of screwing and unscrewing of the latter. These fluted sectors 11 define therebetween spaces 12 allowing a hook-spanner of pin wrench to firmly tighten the lock 3 onto the base flange 1 or to loosen it therefrom.

The body 13 of the base flange 1 comprises a fastening plate 14, a tubular portion 15 made fast with one side of the plate 14 and a tubular nipple or end portion 16 integral with the opposite side of the plate 14 and arranged in coaxial relationship with the tubular portion 15 so as to define together an inner cylindrical passageway. The portion 15 comprises an outer threading 17 having the same pitch as the inner threading 6 of the lock 3 whereas the nipple or end portion 16 also comprises an outer threading 18 adapted to co-operate with a threading ring (not shown) for fastening a cable or wire lead for electrical connection to the end portion 16.

Figure 3:
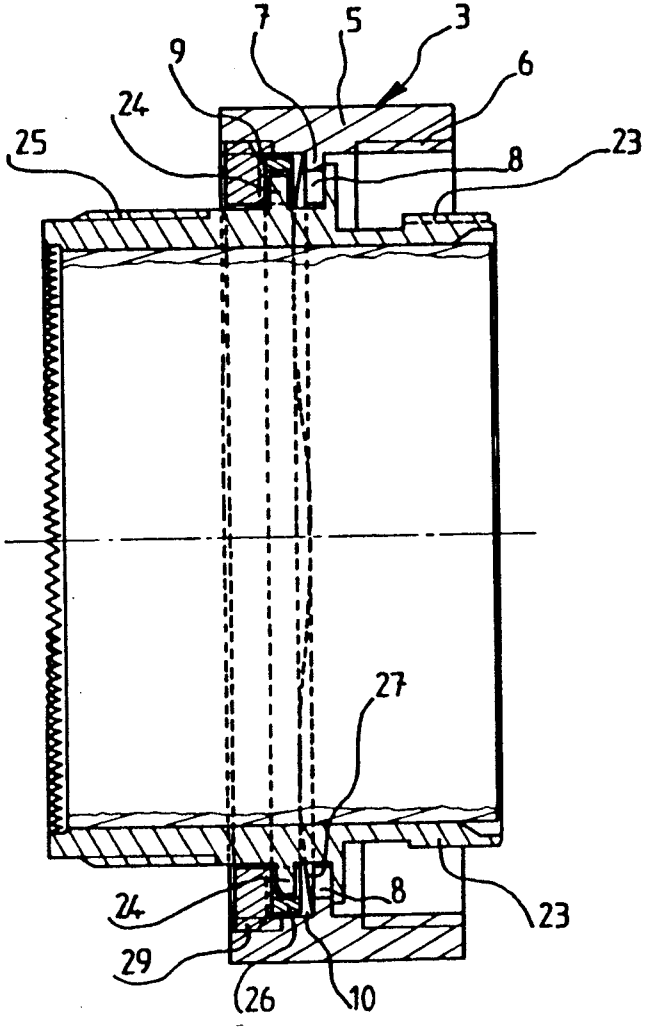
FIG. 3 is a view of the connector in longitudinal section taken upon the line III—III of FIG. 1 in the assembled position.

The plug 2 has its body 4 of a generally cylindrical shape into which is secured an insert 20 made from an electrically insulating material and comprising channels 21 inside of which are received male or female pins (not shown) of the connector. The body 4 comprises a collar 22 located near the transverse medial plane of the body. On the cylinder portion located on the right-hand side of the collar 22 as seen on FIGS. 1 and 3 and adapted to engage the tubular portion 15 of the base flange 1 and at the end thereof are machined a number of angularly and regularly spaced strips or ribs 23. These strips or ribs allow a relative positioning of the plug body 4 with respect to the base flange 1 by engaging grooves (not shown), respectively, located in the cylindrical zone of connection of the tubular portions 15 and 16. The cylinder portion of the body 4 on the left-hand side of the collar 22 comprises from right to left two diametrally opposite pins 24 and an outer threading 25 the nominal diameter of which is smaller than the diameter of the opening defined by the annular wall 7. The threading 25 co-operates with a ring (not shown) for fastening an electric connecting cable or wire lead to the plug body 4.

The plug body 4 and the body 5 of the lock 3 are connected to each other by connecting means which are arranged so as to brake the rotation of the lock 3 with respect to the plug 2 in the unscrewing direction with a force greater than the braking force of the lock 3 in the screwing direction of the latter. These connecting means comprise a first crown-shaped wheel 26 having an outer diameter smaller than the diameter of the annular cavity or recess 10, a resilient member 27 consisting in the present instance of a ripple or corrugated metal washer with an outer diameter smaller than the diameter of the cavity or recess 10 and adapted to exert a drawback force for returning or urging the wheel 26 to or against an annular side face of a crown-shaped second wheel 28 having an outer threading 29 adapted to co-operate with the inner threading 9 having the same pitch. The wheel 26 and the member 27 are thus housed within the cavity 10. The resilient member 27 is interposed between the annular wall 7 and a cooresponding side face of the wheel 26 the opposite side face of which comprise, cut or milled thereinto, teeth or serrations **26*a* meshing with identical teeth or serrations 28*a* cut or milled into the side face located in front of the second wheel 28. The teeth 26*a* and 28*a* are cut so as to comprise abruptly or steeply sloping faces 26*a*1 and 28*a*1, respectively, and opposite gently sloping faces 26*a*2 and 28*a*2, respectively. The first wheel 26 comprises two diametrally opposite thoroughfare inner grooves 26*b* which are engaged by both pins 24, respectively, integral with the plug body 2. When the second wheel 28 is screwed home and blocked to the bottom of the inner threading 9, the teeth 26*a* and 28*a*, respectively, of the wheels 26 and 28 are kept in meshing relationship with each other by the elastic force of the member 27. In the mounted position the wheels 26 and 28 and the resilient member 27 are coaxial with the longitudinal center line axis of the body 13 of the base flange 1 and the collar 22 is bearing against the corresponding annular face or side of the wall 7 opposite to that retaining the resilient member 27. Of course to allow the passage of the threaded portion 25, the wheels 26, 28 and the resilient member 27 have each one an inner diameter greater than the nominal diameter of the threading 25**.

Before fastening the plug 2 to the base flange 1 by the lock 3, the assembly of the body 4 of the plug 2 to the lock body 5 is carried out by inserting the body 4 axially into the lock 3 so that the threaded portion 25 extends through the annular wall 7, the resilient member 27 and the wheels 26, 28 and is then engaging both pins 24 through both grooves 8, respectively, of the wall 7 which are then located within the space portion left free by the resilient member 27 between the first wheel 26 and the wall 7. By turning the plug body 4 with respect to body 5 of the lock 3, both pins 24 are received or accommodated within both grooves **26*b*, respectively, of the first wheel 26. Then the lock 3 is screwed through the threads 9 and 17 to the base flange 1. The rotation of the lock 3 in the screwing direction as shown by the arrow F would rotate in the same direction the second wheel 28 with respect to the first wheel 26 which is held against rotation with respect to the plug body 4 by both pins 24. Thus the gently sloping faces 28*a*2 of the teeth 28*a* of the wheel 28 would slip onto the corresponding faces 26*a*2 of the teeth 26*a* of the wheel 26 thereby generating a relatively weak force braking the lock 3. Once the lock 3 is tightly positioned or blocked against the base flange 1, the unscrewing of the lock which may result from outer vibrations transmitted to the assembled electric connector is prevented by the steeply or abruptly sloping faces 26*a*1, 28*a*1 of the teeth 26*a* and 28*a* of the wheels 26 and 28. The rotation of the lock in the direction reverse from the arrow F would indeed be attended by a rotation in the same direction of the wheel 28 with respect to the wheel 26 but this rotation would be stopped by the abrupt faces of the teeth 28*a* of the wheel 28 moved into abutting engagement with the corresponding steep faces of the teeth 26*a* of the wheel 26. Only a relatively great force applied to the wheel 28 would allow the teeth 28*a* to jump over or to skip the teeth 26*a* and this against the drawback force of the resilient member 27. Thus is provided a tightly blocking of the lock 3 in the unscrewing direction which is effective enough to withstand the forces resulting from outer vibrations tending to unscrew or loosen the lock 3**.

Moreover the mounting and the disassembling of the wheels 26, 28 and of the resilient member 27 are relatively easy to be carried out unlike the electric connectors known heretofore. According to an alternative embodiment it is possible to obtain the same effects mentioned hereinabove by making the wheel 26 fast with the lock 3 and holding the wheel 28 against rotation onto the body 4 of the plug 2 by means of snugs like the pins 24, the resilient member 27 being of course located towards the wheel 28 so that the teeth 28*a* of the latter be kept elastically in meshing engagement with the teeth 26*a* of the wheel 26, which teeth have their gently sloping faces slipping onto one another when the wheel 26 is driven in the direction of rotation corresponding to the screwing of the lock and their steeply sloping faces coming into engagement with each other in the direction of unscrewing of the lock 3.

What is claimed is:

1. An electric connector of the kind comprising a base flange, a plug, a lock mounted onto a plug body for making the plug fast with the base flange through screwing and connecting means between the plug body and the lock for braking the rotation of the lock in either direction with respect to the plug body and arranged so as to brake the rotation of the lock in the direction of unscrewing thereof with a force greater than the force for braking the lock in the direction of screwing of the latter, wherein the improvement consists in that the connecting means comprise two coaxial first and second wheels, mutually confronting side faces of which comprise teeth, each one with gently and steeply sloping faces, respectively, kept in meshing engagement with each other by the drawback force of a resilient biassing member, the second wheel being made fast with the lock body whereas the first wheel is held against rotation with respect to the plug body and is axially displaceable with respect thereto against the drawback force of the resilient biassing member, so that the rotation of the lock in the screwing direction would cause the gently sloping faces of the teeth of the second wheel to slip onto the corresponding gently sloping faces of the teeth of the first wheel and the rotation of the lock in the unscrewing direction would bring the steeply sloping faces of the teeth of the second wheel in abutting engagement against the corresponding steeply sloping faces of the teeth of the first wheel.

2. A connector according to claim 1, wherein both toothed wheels are made from hard steel.

3. A connector according to claim 1, wherein the plug body comprises at least one pin integral therewith and engaging an inner groove of complementary shape of said first wheel.

4. A connector according to claim 3, wherein both diametrally opposite pins are integral with the plug body and engaging two complementary inner grooves, respectively, of the first wheel.

5. A connector according to any one of claims 1–4, wherein said second wheel is made fast with the lock body by screwing it into the lock body.

6. A connector according to claim 1, wherein the resilient biassing member consists of a corrugated ring interposed between a side face of the first wheel opposite from its toothed face and an inner annular wall of the lock body.

7. A connector according to claim 6, wherein said first wheel and the resilient ring are accommodated within an annular cavity defined between the second wheel and said inner annular wall.

8. A connector according to claim 6, wherein for assembling the lock to the plug body, said inner annular wall of the lock comprises two grooves for the passage of both pins, respectively, between said first wheel and the inner annular wall, both pins being then received into two grooves, respectively, of the first wheel by rotating the plug body with respect to the lock.

9. A connector according to claim 6, wherein the plug body comprises a collar bearing against the side face of said inner annular wall opposite from that against which is bearing the resilient biassing member.

10. A connector according to claim 9, wherein the lock comprises an inner threading formed towards that side face of said inner annular wall onto which is bearing said collar and co-operating with a corresponding outer threading of a base flange body.

* * * * *

UNITED STATES PATENT AND TRADEMARK OFFICE

CERTIFICATE OF CORRECTION

PATENT NO. : 5,035,640

DATED : July 30, 1991

INVENTOR(S) : Pierre Louis Marie DROGO

It is certified that error appears in the above-identified patent and that said Letters Patent is hereby corrected as shown below:

Col. 2, line 6 change "pins" to --pin--.

Col. 2, line 29, change "snugs" to --pins--.

Col. 2, line 30, change "snugs" to --pins--.

Col. 3, line 10, change "of" to --or--.

Signed and Sealed this

Twenty-second Day of December, 1992

*Attest:*

DOUGLAS B. COMER

*Attesting Officer*

*Acting Commissioner of Patents and Trademarks*